United States Patent [19]

Ishiki et al.

[11] Patent Number: 4,697,420

[45] Date of Patent: Oct. 6, 1987

[54] STIRLING CYCLE ENGINE

[75] Inventors: Naotsugu Ishiki, Tokyo; Yuji Takei, Takasaki, both of Japan

[73] Assignee: Sanden Corporation, Japan

[21] Appl. No.: 873,980

[22] Filed: Jun. 13, 1986

[30] Foreign Application Priority Data

Jun. 13, 1985 [JP] Japan ..... 60-88212[U]

[51] Int. Cl.[4] ..... F01K 1/04

[52] U.S. Cl. ..... 60/517; 60/526

[58] Field of Search ..... 60/517, 525, 526

[56] References Cited

U.S. PATENT DOCUMENTS 4,267,696 5/1981 Lindskoug ..... 60/526

4,578,949 4/1986 Takei et al. ..... 60/526 X

*Primary Examiner*—Allen M. Ostrager

*Attorney, Agent, or Firm*—Banner, Birch, McKie & Beckett

[57] ABSTRACT

A Stirling cycle type engine is disclosed in which a displacer piston and power piston operate within a cylinder due to flow of a working fluid which is heated and cooled by a heater element and a cooler element. The cylinder is divided into an upper expansion chamber and a lower compression chamber by a displacer piston. The lower chamber is defined between the displacer piston and power piston. The upper chamber and lower chamber are connected to one another through a serially interconnected heater, a regenerator and a cooler, whereby the working fluid flows into the lower chamber from the upper chamber or vice versa. The regenerator and the cooler are disposed on one outer peripheral side of the cylinder and vertically aligned therewith. Thus, the radial size of the engine is reduced without reducing its efficiency.

3 Claims, 4 Drawing Figures

STIRLING CYCLE ENGINE

BACKGROUND OF THE INVENTION

This invention relates to a Stirling cycle engine in which heat from an external source is converted to useful mechanical energy. More particularly, the present invention relates to an improved arrangement of the heater, regenerator and cooler elements of the engine to provide an engine which is more compact without any loss of operating efficiency.

Stirling cycle engines are well-known in the prior art. A conventional Stirling cycle machine operates on a regenerative thermodynamic cycle, with cyclic compression and expansion of the working fluid at different temperature levels. The fluid flow is controlled by volume changes which create a set conversion of heat to work or vice versa. In a typical stirling engine, operating as a prime mover, heat is supplied to the working fluid when the fluid is in a "hot" or expansion chamber. Part of the heat is converted to work when, due to the absorbed heat, the working fluid, expands and thereby pushes on a piston which is coupled to a crank shaft that impart rotary motion. The working fluid is then displaced by a displacer through the regenerator, where most of the heat is drawn off. The working fluid is then forced into a "cold" or compression chamber, which is at some lower temperature. The piston then compresses the working fluid at the lower temperature. Thereafter, the working fluid is forced out of the cold chamber by a displacer, through the regenerator and into the hot chamber. As it passes through the regenerator the working fluid reabsorbs some of the heat previously deposited there. In the hot chamber, the working fluid again absorbs heat and the cycle of operation repeat itself. Therefore, the crank shaft is rotated due to the reciprocating motion of the displacer.

U.S. Pat. No. 4,578,949 issued to Takei et al, discloses one embodiment of a compact Stirling cycle machine. FIG. 1 is a cross sectional view of a prior art embodiment of a Stirling cycle engine 1. Engine 1 includes a displacer piston 2 and a power piston 3 operating within a cylinder 4. Cylinder 4 is divided into an upper expansion chamber 4*a* and a lower compression chamber 4*b* by displacer piston 2 and power piston 3. The upper chamber 4*a* and lower chamber 4*b* are connected with one another through a heater 5, regenerator 7 and cooler 6. The working fluid thereby can flow into the lower chamber 4*b* from the upper chamber 4*a* or vice versa. Heater 5, which receives heat from heat sources and communicates with upper chamber 4*a* of cylinder 4, projects radially from the top portion of cylinder 4 to extend over the heat source. Cooler 6, which communicates with lower chamber 4*b* of cylinder 4, projects radially from the lower portion of the cylinder 4 on the opposite side from which heater 5 extends. Therefore, the function of cooler 6 is not affected by the heat source, which results in a more efficient operation. However, this typical construction results in the engine having a large radial size, defined by the length of both heater 5 and cooler 6.

SUMMARY OF THE INVENTION

It is a primary object of this invention to provide an improved Stirling cycle type engine in which the radial dimension is reduced without reducing the efficiency of the engine.

It is another object of the invention to provide an improved Stirling cycle engine which is easier to assemble.

A Stirling cycle type engine according to this invention includes a power piston and a displacer piston, both of which are slidably carried within a cylinder in which a working fluid is enclosed. A movable displacer piston divides an internal space of the cylinder into two chambers. These two chambers are connected with one another through at least one of a cooler, a regenerator, or a heater. The cooler, regenerator and heater are all positioned on one side of the cylinder and vertically aligned therewith and are serially interconnected.

Further objects, features and other aspects of this invention will be understood from the following detailed description of the preferred embodiment of this invention referring to the annexed drawings.

DETAILED DESCRIPTION

Figure 1:
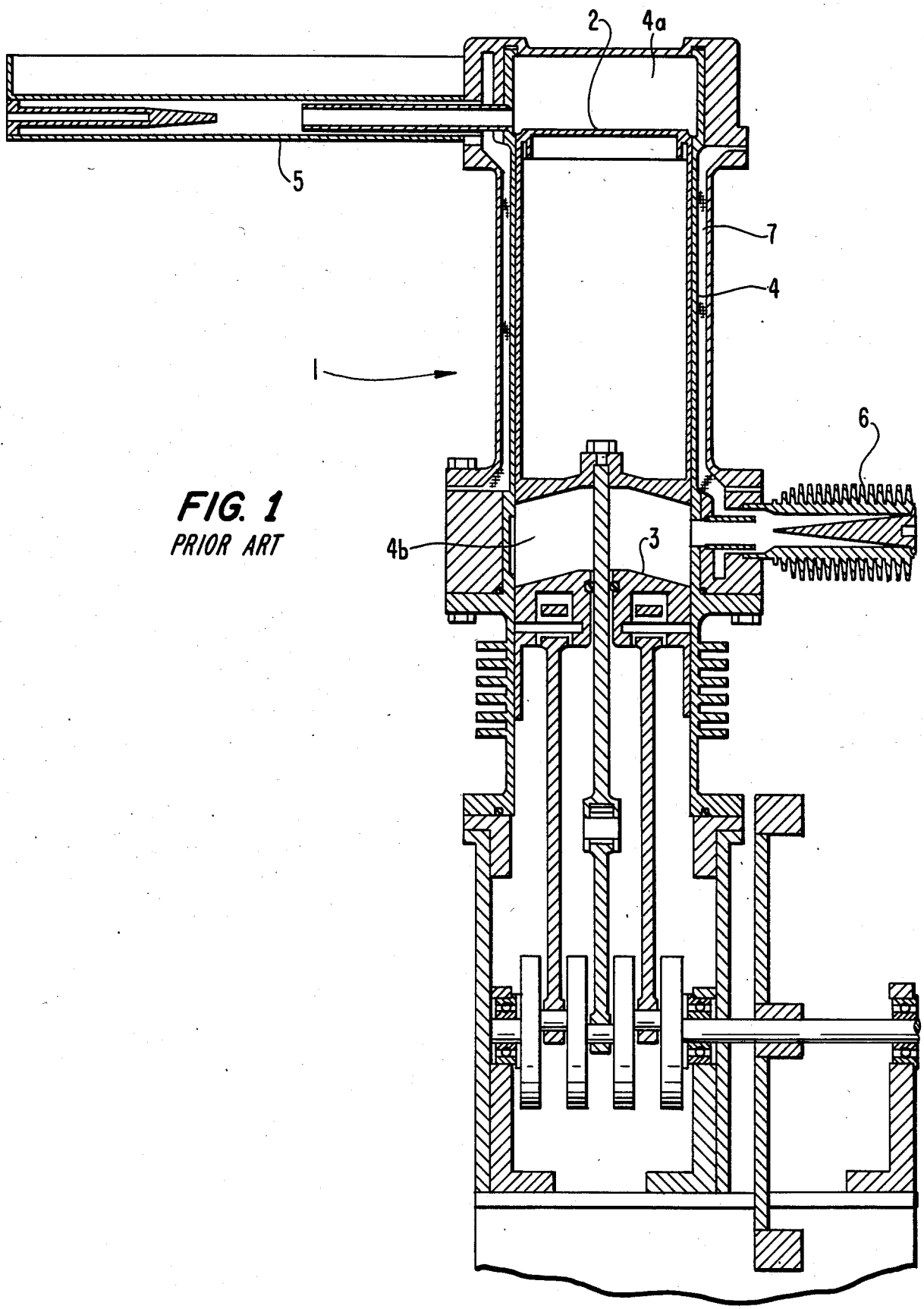
FIG. 1 PRIOR ART
FIG. 1 is a cross sectional view of a prior art Stirling cycle type engine.
Figure 2:
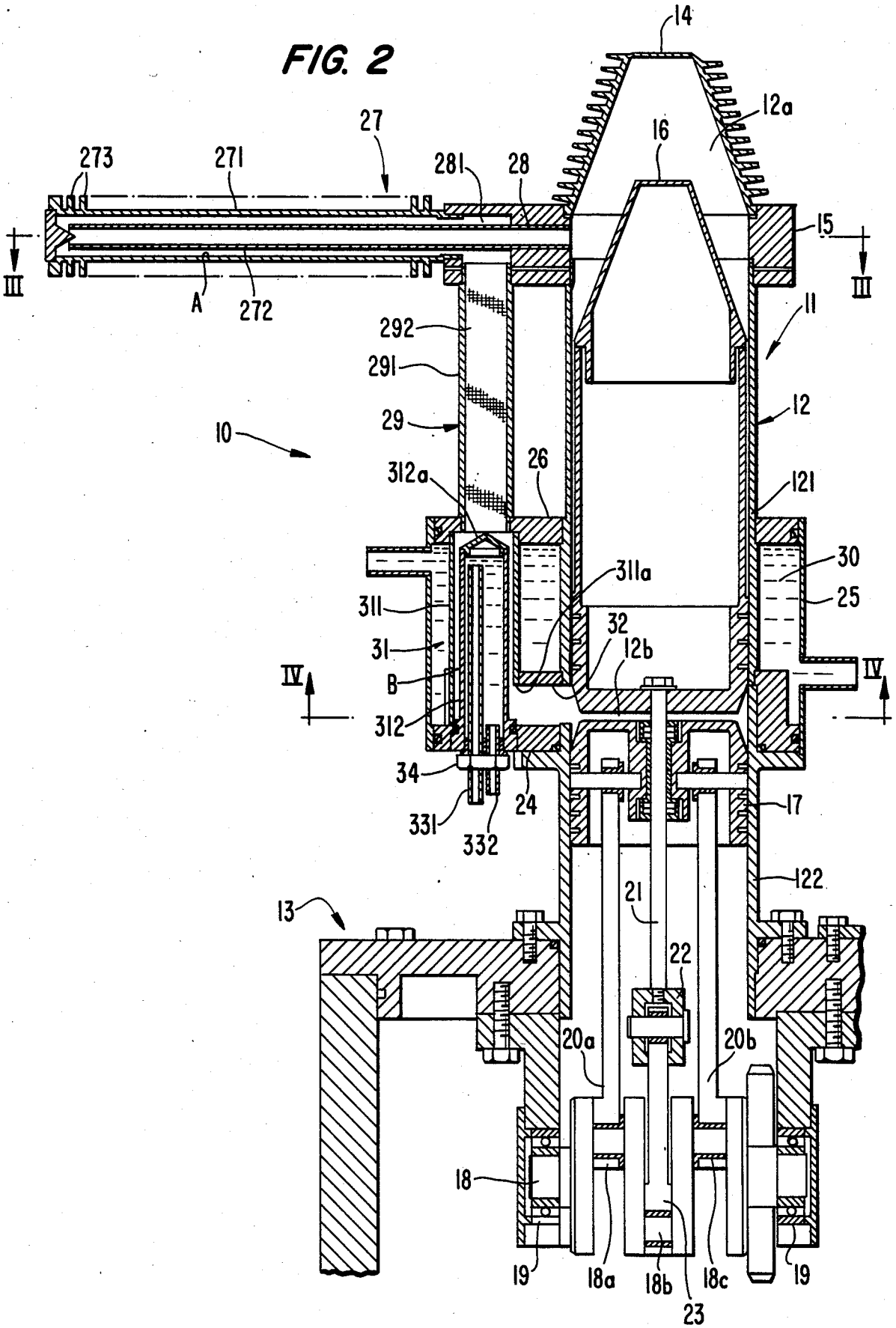
FIG. 2 is a cross sectional view of Stirling cycle type engine in accordance with one embodiment of this invention.

Referring to FIG. 2, a Stirling cycle type engine according to one embodiment of this invention is shown. The engine 10 comprises an annular housing 11 having a cylinder 12 disposed on a crank case 13. A cylinder cap 14 is disposed on an upper opening portion of cylinder 12 and fixed thereon through first support plate 15 to close the opening portion of cylinder 12.

A displacer piston 16 is slidably carried within cylinder 12 and divides cylinder 12 into two chambers. A power piston 17 is also slidably carried within cylinder 12 and placed in the lower portion of cylinder 12. A top surface of power piston 17 faces the bottom surface of displacer piston 16. The upper chamber of cylinder 12 functions as a "hot" or expansion chamber 12*a*. The space defined between displacer piston 16 and power piston 17 functions as a "cold" or compression chamber 12*b*. Both pistons 16 and 17 are linked to a crank shaft 18 which is rotatably supported in crank case 13 through bearings 19. Crank shaft 18 has three cranks 18*a*, 18*b*, 18*c* extending from it. The two outside cranks 18*a* and 18*c* extend from crank shaft 18 at the same angle and are linked to power piston 17 by two parallel connector rods 20*a*, 20*b*. Displacer piston 16 is actuated by middle crank 18*b*, which is offset by a certain angle from the other two cranks 18*a*, 18*c*. Displacer piston 16 is coupled to middle crank 18*b* through a rod 21 which is linked by a linkage 22 to connector rod 23 fastened on crank 18*b*.

As shown in FIG. 2, cylinder 12 comprises an upper element 121 and a lower element 122, both of which are connected by second support plate 24. An annular cylindrical member 25 is disposed around an outer peripheral surface of cylinder 12 adjacent to cold chamber 12*b*. A lower opening of cylindrical member 25 is closed by second support plate 24. An upper opening of cylindrical member 25 also is closed by a third support plate 26. The space defined by cylindrical member 25, the outer peripheral surface of cylinder 12, and the second and third support plates 24, 26 functions as a cooling tank 30 to circulate cooling water.

Figure 3:
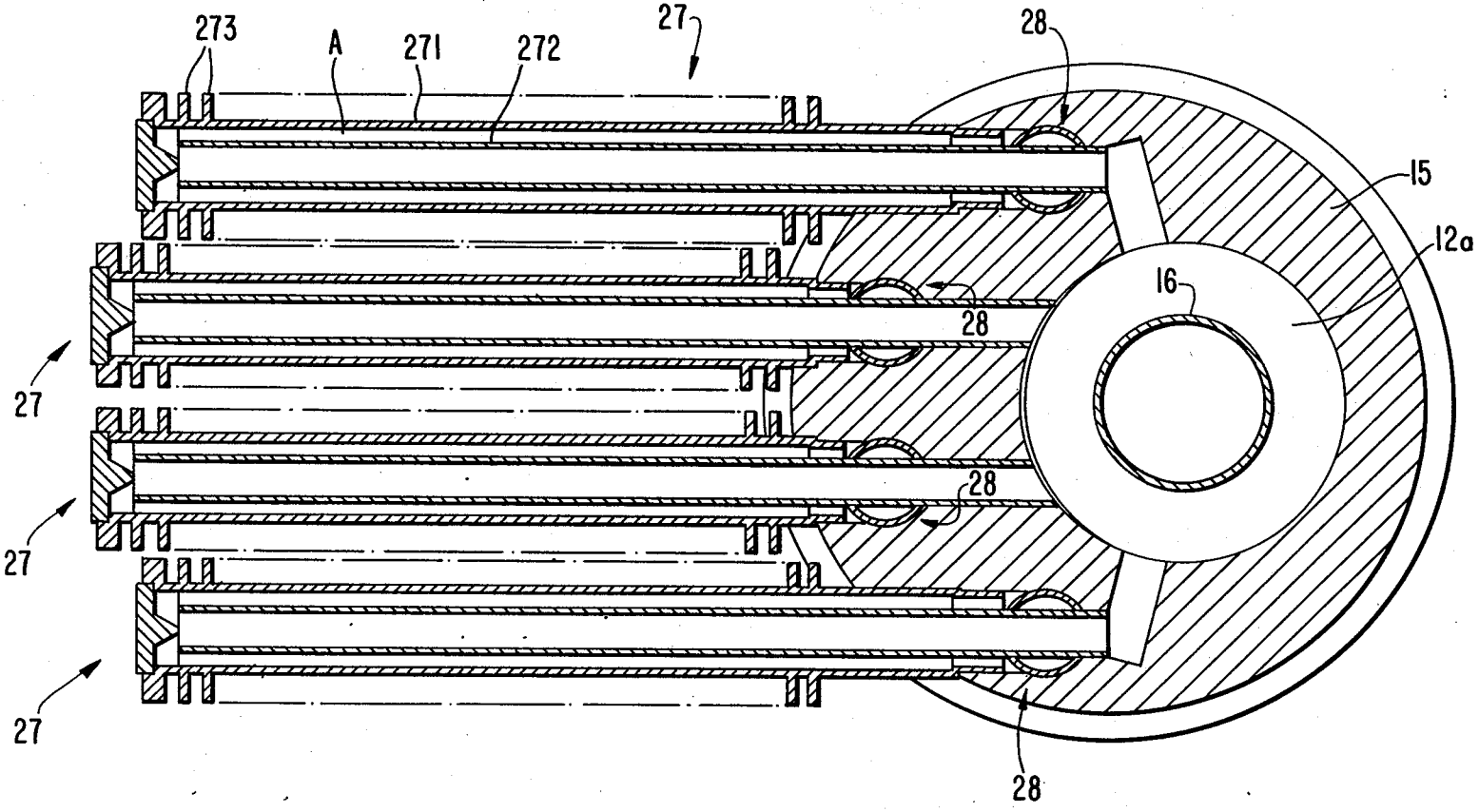
FIG. 3 is a sectional view taken along line III—IIII in FIG. 2.

Referring to FIGS. 2 and 3, a plurality of heaters 27 project radially from first support plate 15 to extend over a heat source. (In FIG. 3, four heaters 27 are shown.) Each heater 27 comprises an outer tube element 271 and an inner tube element 272 defining fluid passageways. One end portion of each outer tube element 271 is fastened on an outer end portion of bore 28 formed through first support element 15 to communicate with the interior of expansion chamber 12*a* of cylinder 12. The other end position of each outer tube element is closed. Since, inner tube element 272 extends within the interior of outer tube element 271 with a gap to define fluid passage space A, outer tube element 271 communicates with the interior of inner tube member 272 and also communicates with hollow space 281 formed in bore 28. Hollow space 281 of each communication bore 28 is connected to a regenerator 29. A plurality of annular fins 273 are defined on the outer peripheral surface of outer tube element 271 for promoting heat exchange.

A plurality of regenerators 29 extend vertically parallel to but spaced from the outer peripheral surface of cylinder 12. Each regenerator 29 comprises a cylindrical tube element 291. Wire cloth 292 is disposed within the interior of tube element 291. The upper end of tube element 291 is fixed on first support plate 15 and communicates with hollow space 281. The lower end of tube element 291 is fixed on third support plate 26.

Figure 4:
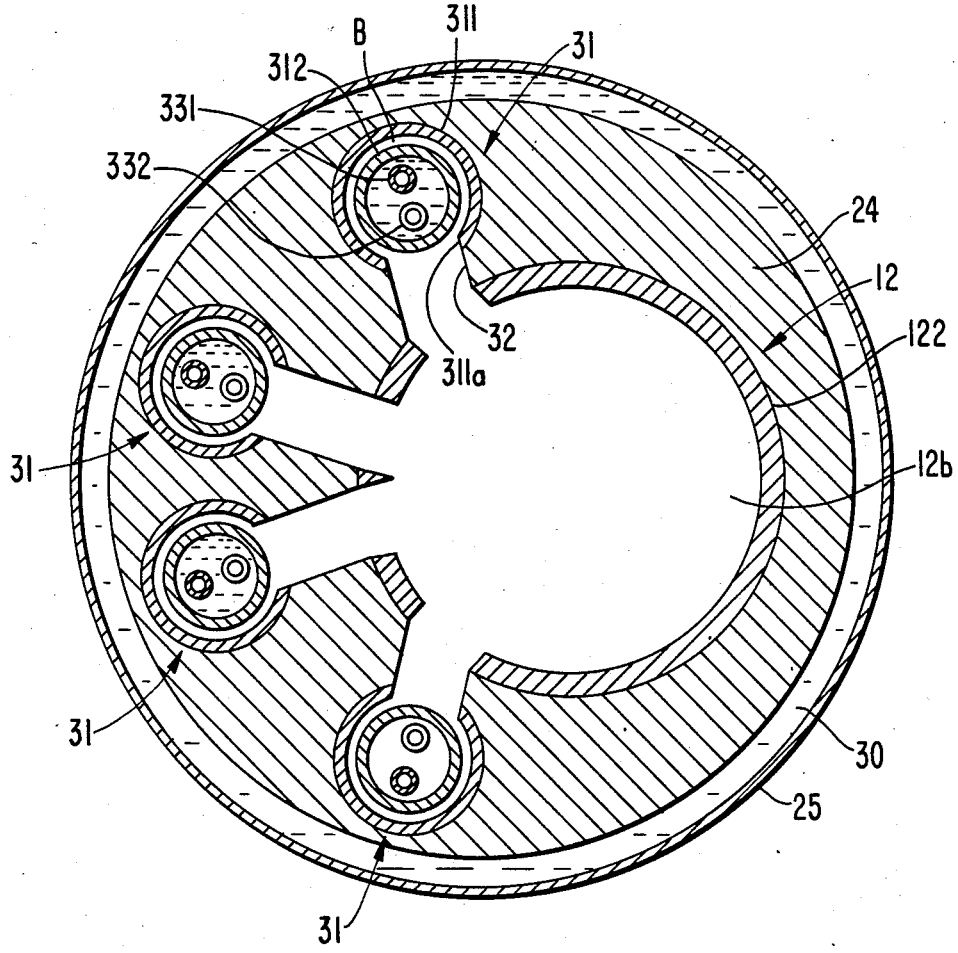
FIG. 4 is a sectional view taken along line IV—IV in FIG. 2.

Referring to FIGS. 2 and 4, a plurality of coolers 31 extend vertically within the interior space of cooling tank 30. Each cooler 31 comprises an outer tube element 311 and an inner tube element 312. The upper end of outer tube element 311 is fixed on third support plate 26 for communicating with the lower portion of regenerator 29. The lower opening of outer tube element 311 is covered by support plate 24. The interior space of outer tube element 311 communicates with compression chamber 12*b* of cylinder 12 through side opening 311*a* of outer tube element 311 and communication bore 32 formed through second support plate 24. Inner tube element 312 extends within the interior space of outer tube element 311. The inner opening of tube element 312 is closed by a cap 312*a* to thereby define the fluid passage space B. The lower end portion of inner tube element 312 is fixed on second support plate 24. Cooled water can be circulated within the interior of inner tube element 312 by inlet and outlet tube elements 331, 332, both of which are fixed on screw element 34 and extend within the interior of inner tube element 312. Therefore, in operation, the working fluid of the engine passes through fluid passage space B between the inner surface of outer tube element 311 and the outer surface of the inner tube element 312 and is cooled by the cool water circulating through the inner tube element 312 and cooling tank 30.

The thermal process by which the apparatus operates will now be described. If power piston 17 is in its lower position, while displacer piston 16 is in its uppermost position, all gas enclosed in the system will be forced into compression chamber 12*b*. With the pistons in this position, chamber 12*b* is at its largest volume. Power piston 17 thereafter moves upward to compress the gas in chamber 12*b*; and displacer piston 16 moves downward to force the compressed gas through cooler 31, regenerator 29, heater 27 and into expansion chamber 12*a*. When power piston 17 is in its uppermost position and displacer piston 16 has moved to a lower position wherein the volume of compression chamber 12*b* is at a minimum, all the compressed gas will be in expansion chamber 12*a*. The heat from heater 27 causes the gas in expansion chamber 12*a* to expand, and both power piston 17 and displacer piston 16 move downward to their lowest position. While power piston 17 remains in its lowermost position, displacer 16 moves upward and pushes the gas from chamber 12*a*. During its passage from expansion chamber 12*a* to compression chamber 12*b*, the gas gives up a large part of its heat to regenerator 29 and its remaining heat to cooler 31. All gas will be forced into compression chamber 12*b* when displacer piston 16 is in its intermediate stage of pushing the gas into chamber 12*b*, i.e., prior to reaching its uppermost position. The cycles of operation thereafter are repeated with the cooled gas passing from chamber 12*b* to chamber 12*a* and recovering heat from regenerator 31.

As stated above, the heater, the regenerator, and the cooler are serially connected to one another and communicate between the expansion chamber and compression chamber, both of which are defined in the cylinder 12. Additionally, the arrangement and serial interconnection of the heater, regenerator and cooler with the expansion and compression chambers is such that these elements are all positioned on one common side of cylinder 12. Therefore, the radial dimension of the Stirling cycle engine is significantly reduced from prior designs and the engine can be formed in a significantly more compact size.

This invention has been described in detail in connection with the preferred embodiment, which is an example only of the invention with the preferred embodiment, which is an example only of the invention the invention is not restricted thereto. It will be easily understood by those skilled in the art that other variations and modifications can be readily made within the scope of this invention as defined by the following claims.

We claim:

1. In a Stirling cycle type engine including a cylinder having a cylinder cap, a power piston and a displacer piston both slidably carried within said cylinder, said displacer piston dividing the interior of said cylinder into two chambers one of which is located between said power piston and displacer piston, said two chambers being connected to one another through cooler means for cooling a fluid in said apparatus, a regenerator means for absorbing heat from a fluid and heater means for heating a fluid in said apparatus, the improvement comprising:

said cooler means comprising a cooling tank formed around the lower portion of said cylinder and plurality of cooler elements, said cooler elements defining cooler flow passageways within said cooling tank, and means for circulating a cooling fluid within said cooler means;

said regenerator means comprising regenerator elements defining regenerator flow passageways;

said heater means comprising heater elements defining heater flow passageways;

said cooler flow passageways, said heater flow passageways and said regenerator flow passageways serially connected with one another;

said cooler means and said regenerator means being disposed on a common peripheral side of said cylinder and vertically aligned therewith to thereby reduce the radial extension of the engine.

said regenerator means extending vertically and parallel to but spaced from the outer peripheral wall of said cylinder, said regenerator means comprising a cylinderical tube, the upper end of said tube communicating with said heater means.

2. The Stirling cycle type engine of claim 1 wherein said regenerator means comprises an annular tube element and a wire cloth disposed within said tube element.

3. In a Stirling cycle type engine including a cylinder having a cylinder cap, a power piston and a displacer piston both slidably carried within said cylinder, said displacer piston dividing the interior of said cylinder into two chambers one of which is located between said power piston and displacer piston, said two chambers being connected to one another through cooler means for cooling a fluid in said apparatus, a regenerator means for absorbing heat from a fluid, and heater means for heating a fluid in said apparatus, the improvement comprising said cooler means and said regenerator means being serially connected and disposed on a common peripheral side of said cylinder and vertically aligned therewith to thereby reduce the radial extension of the engine;

said cooler means comprising an annular cylindrical member disposed around an outer peripheral surface of said cylinder, said annular cylindrical member defining a cooling tank for the circulation of cooling water;

said chambers comprising an upper expansion chamber and a lower compression chamber, said compression chamber located between said power piston and said displacer piston;

said heater means communicating with said expansion chamber;

said regenerator means extending vertically and parallel to but spaced from the outer peripheral wall of said cylinder, said regenerator means comprising a cylindrical tube, the upper end of said tube communicating with said heater means; and cooler elements extending vertically within said cooling tank, said cooler elements comprising an outer tube element and an inner tube element within and spaced from the inner periphery of said outer tube thereby defining a fluid passageway, said outer tube element communicating with said regenerator means and said compression chamber, said inner tube element having an inlet and outlet for ingress and egress of cooled fluid so that the working fluid of said engine passes through said fluid passageway and is cooled by cooling fluid in said inner tube element and said cooling tank, said heater means, said cooler means and said regenerator means are thereby serially connected to each other and communicate between said expansion and compression chambers in said cylinder.

* * * * *